United States Patent [19]

Ridler et al.

[11] 4,002,253

[45] Jan. 11, 1977

[54] ATTACHMENT FOR ARTICULATED VEHICLE

[75] Inventors: Kenneth B. Ridler; Frank Walsh, both of Thunder Bay F, Canada

[73] Assignee: Vesco Manufacturing and Supply Limited, Thunder Bay, Canada

[22] Filed: Feb. 3, 1975

[21] Appl. No.: 546,740

[52] U.S. Cl. ..... 214/147 G; 214/707

[51] Int. Cl.[2] ..... B66C 1/00

[58] Field of Search ..... 214/147 R, 147 G, 707

[56] References Cited

UNITED STATES PATENTS

| | | | |
|---|---|---|---|
| 3,281,119 | 10/1966 | Westfall | 214/147 R |
| 3,411,647 | 11/1968 | Zimmerman | 214/770 |
| 3,491,906 | 1/1970 | Davidson | 214/770 |
| 3,549,031 | 12/1970 | Blood | 214/147 R |
| 3,669,293 | 6/1972 | Bryan | 214/147 R |
| 3,731,827 | 5/1973 | Eaves | 214/770 |
| 3,872,991 | 3/1975 | Pasideris | 214/770 |
| 3,877,743 | 4/1975 | Johnson | 214/147 G |
| 3,907,137 | 9/1975 | Korbel | 214/147 R |

*Primary Examiner*—Robert R. Song
*Assistant Examiner*—John A. Carroll

[57] ABSTRACT

A boom is mounted by a linkage on the forward member of an articulated vehicle. A link connects the forward member to the boom and in front of this an hydraulic piston and cylinder also connects the forward articulated member to the boom. Rotation of the link will move the boom forwardly or rearwardly while extension and retraction of the piston and cylinder raises and lowers the boom.

6 Claims, 5 Drawing Figures

ATTACHMENT FOR ARTICULATED VEHICLE

This invention relates to means to provide material handling on articulated vehicles. horizontal'.

By articulated vehicles we mean front and rear frames which are pivotably or swingably joined, hence the name 'articulated'. Wheel bearing axles are attached to each of the front and rear members with the wheels acting to rollably support the members and whatever type of load is carried thereon. Steering is primarily achieved by controlling and varying the articulation angle between the front and rear frame members, usually through hydraulic cylinders. Thus the invention is for use with such articulated members, primarily steered as described, whether or not such primary means of steering is in some cases augmented by Ackerman steering.

It is the object of this invention to provide, for use on an articulated vehicle of this type wherein the operator sits in the forward one of the two articulated members, a material handling boom and control solely mounted on the forwardly articulated member, whereby the operator may conveniently control the operation of the boom and material handling means at the forward end thereof, which is located closely to him and within his field of vision.

The invention is primarily concerned with a development where the material handling means is a pair of clam jaws or arms arranged to depend downwardly from the forwardly projecting end of the boom. There is provided a linkage for controlling the operation of such boom for best utilization of the qualitites of the articulated vehicle on the one hand, and of the boom and clam mechanism mounted thereon. It will be appreciated that the provision of a linkage for attachment to the forward articulated member of an articulated vehicle, wherein the operator sits, (preferably) in the forward articulated member, allows maximum visibility and control, which is of course augmented by the fact that the linkage turns with the forward articulated member during steering of the vehicle and of course the attachment of the linkage solely to the forward member allows its simple construction, not otherwise, possible with an articulated vehicle.

The linkage cooperates with and mounts a boom designed to project forwardly from the forward member of the articulated vehicle, above which forward articulated member, the boom is supported by the linkage comprising a more rearwardly located link and a more forewardly located hydraulic piston and cylinder means. (The latter is often known as the 'raise' cylinder). Both the link and the raise piston cylinder are mounted to pivot on pivotal axes connected at one end to the boom and at the other to the forward articulated member. These pivotal axes are arranged when pivotally connected to the forwardly articulated member to be substantially transverse to the vehicle and mutually parallel, and the linkage is designed so that, with the piston in the hydraulic cylinder means fully or almost fully retracted, the rotation of the link can move the boom and the clam jaws depending from the end thereof, between retracted and extended position. The linkage is designed so that, with the piston in the hydraulic cylinder means retracted, a stable location of the boom (and any load in the jaws) is achieved for highway travel. Preferably the linkage is so designed that with the raise piston cylinder retracted, the free end of the boom will become depressed in moving from retracted to extended position. This allows the clam jaws to be designed to be suspended above the travelling surface in a relatively retracted position of the link and boom; but to be movable, with boom extension, below the travelling surface, so that, if desired, clam operation may be achieved at a lower level than that on which the vehicle wheels are resting. The arrangement whereby, with the raise piston fully or almost fully retracted, the forward movement of the linkage and boom depresses the claim jaws, is found to provide excellent handling qualities of the equipment in allowing the open clam jaws to penetrate a pile of material to be lifted and the closure of the clam jaws to gather such materials. Such handling qualities are known as 'crowding qualities' and not only include the strength of insertion of the jaws in a pile, and their gathering qualities but include the sensitivity with which this may be performed.

The retracted position of the boom, under control of the linkage to a degree varying with the kind of load, and the sway contributed thereby has been found to provide the optimum stability for fast highway travel.

The extension and retraction of the piston in the hydraulic cylinder means is designed to vary the angle of extension of the boom from its pivotal connection to the link, and the boom is preferably concavely downwardly curved so that the adjacent one of the clam jaws, at high angles of the boom, may be received within a concave curvature thereof.

The linkage is preferably designed so that in its retracted position (as well as the other available positions) it does not interfere with the opening of the vehicle doors and hence with the safety of the operator.

In drawings which illustrate a preferred embodiment of the invention:

Figure 1:
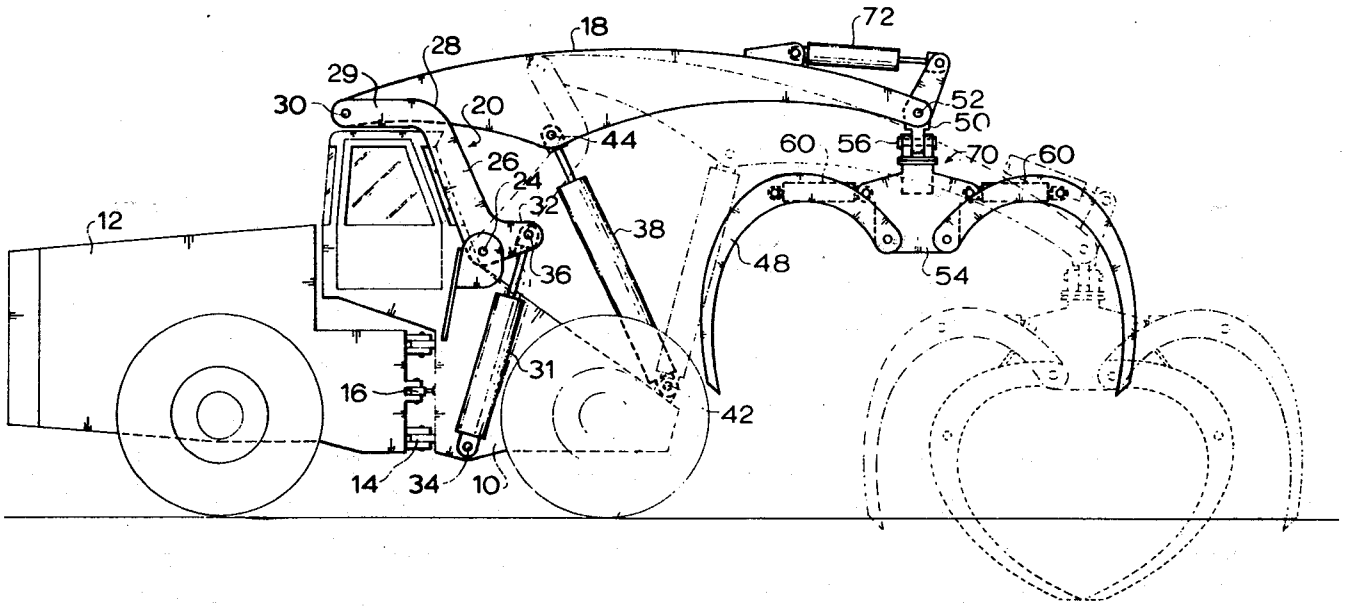
FIG. 1 shows a side view of the articulated vehicle with the boom retracted and the cylinder retracted.

In the drawings is shown an articulated vehicle comprising a forward articulated member 10 and a rearward articulated member 12 joined at an articulated joint 14. Although only indicated schematically, steering of the vehicle is customarily performed by hydraulic pistons 16 connecting the forward and rearward articulated members on each side of the main articulation joint 14. The expansion and retraction of the pistons in accord with well known hydraulic controls and tachniques, allows the variation of the angle between the forward and rearward portions of the devices and hence the steering of the vehicle. The particular vehicle shown is a 'Hough Payloader' manufactured by the International Harvest Co. of Chicago, Illinois U.S.A. However, the invention is intended for use with any articulated vehicle which has, in common with the 'Hough Payloader°. the provision of an operator located in the forward articulated member. Such operator is therefore able to ably and efficiently control the operation of the boom forwardly extending from this member, since his location allows him full visibility and he is always facing in the extension direction of the boom. It will be preferable and in many cases essential, that any articulated vehicle with which the invention is used, have the motor, in the rearward articulated member to counterbalance the weight of the forwardly extending boom, and any load carried thereon. This is the case in the 'Hough Payloader' shown.

The invention provides a boom comprising spaced and rigidly connected members 18 designed to support clam jaws, or other load handling equipment at the outer end and connected to the forward articulated member at the inner end. Although the boom and linkage provided may be used with other material handling equipment, the equipment is particularly designed for clam jaws, connected to depend downwardly from the outer end of the boom. The linkage mounting the boom comprises, a pair of spaced link members 20 pivotably mounted at pivotal mountings 24 on opposite sides of the forward articulated member. These link members are spaced wider than the forward end of the cab and are joined by cross-braces 22 to form a rigid frame. The pivotal mountings 24 are located at proper mounting points on the frame of the forward articulated member, selected for their strength and convenience. The pivotal connections 24 are oriented transverse to the machines and to be approximately horizontal when the machine is standing on level ground. (This is the sense in which 'horizontal' is used herein). The axes of the connections 24 are of course substantially coincident and the axis is sometimes referred to in the claims as a first pivotal axis. The link members comprise an upward extent 26 from the pivot points to an elbow 28 at the approximate height of the cab and an extent 29, extending rearwardly and upwardly from the elbow, to a pair of pivotal connections 30 to the boom and located adjacent the rearward extremity of the boom. The axis of pivotal connections 30 are coincidental and are substantially parallel to the axis of pivotal connections 24. The axis of pivotal connections 30 is sometimes connected as shown. Control for the orientation of the links 20 is achieved by providing forward projections 32 from the lower ends of the links adjacent pivot points 24, and providing a hydraulic cylinder means 31 on each side of the forward articulated member. The hydraulic cylinder means comprises a hydraulic cylinder 31 with a piston contained therein and connectible to means for activating the piston and rod between retracted and extended position relative to the cylinder. Thus the cylinder is pivoted at the end remote from the piston to the projection 3 at pivot point 36 and the projecting piston rod at the other end is pivoted at 34 to a suitable mounting location on the forward articulated member, the locations of the pivot points 36 and 34 being selected so that expansion and retraction of the piston exerts torque on the link to cause it to turn about the pivot point. Alternative means of control of the orientation of the link 20 to the hydraulic cylinder 31 having equivalent power and flexibility of control is considered within the scope of the invention. Forwardly of the linkage pivot piston cylinder means are provided on each side of the frame which comprises a cylinder 38 with a piston not shown and rod 40 movable therein under the control of a hydraulic supply lines not shown to the piston. One of: the projecting end of the piston rod or the opposite end of the cylinder thereto (here the latter) is connected to the forward articulated frame at a pivot 42. The coincident axes of the two pivots 42 are herein sometimes referred to as the third pivot axis. The other end of each hydraulic cylinder means, (here the piston rod) is connected to the corresponding spaced member 18 of the boom, at a pivotal location 44 forward of the pivotal connections 30.

At the forward end of the boom, are provided two pair of cooperating clam jaws or arms 48 which are arranged to depend downwardly from their attachment to the boom. An intermediate block 50 is pivotably connected to the outer end of the boom at 52 to pivot relative thereto about a horizontal axis transverse to the longitudinal extension direction of the boom. The jaw assembly member 54 carrying controls to determine the opening and closure of the jaws, is mounted to swing from the intermediate block 50 about an axis 56 perpendicular to axis 52. The jaw assembly is thus universally connected to the end of the boom to depend under gravity therefrom. This point is emphasized because the fact that the jaws or equivalent load handling apparatus depend under gravity instead of moving with the boom in a fixed orientation relative thereto. This allows movement of the boom between extended and retracted position in non-parallel relationship allowing design of the boom linkage for function and stability uninhibited by any need for concern about the orientation of the clam jaws. Piston cylinders 60, schematically shown are provided to control the opening and the closing of the jaws. As schematically indicated, the jaw assembly member 54 is preferably provided with a rotary pivot connection, 70 to allow rotation of the jaws about a vertical axis relative to the mount. Flexible hydraulic controls, not shown, are provided extending from the cab to the rotary pivot connection 70 on the one hand and the opening and closing of the jaws on the other hand. An hydraulic damping cylinder 72 is mounted to extend between the boom members 18 and an upward projection from intermediate block 50. This cylinder does not exert a control function but merely damps the vibrations created by the pendularly hanging jaws. If desired, a damper piston may be connected to damp vibration between the intermediate block 60 and the jaw assembly member 54. The linkage comprising links 20 and the piston-cylinder means 38–40, is designed (through its shape and dimensions, and selection of the location for joining to the boom 18 and to the forward articulated member) to allow extension and retraction of the boom 18 for operation and material handling with the clam jaws and also to achieve stability with all members retracted for higher speed travel, and stability with the hydraulic cylinder means 38 extended for use in low speed machine operations.

Figure 2:
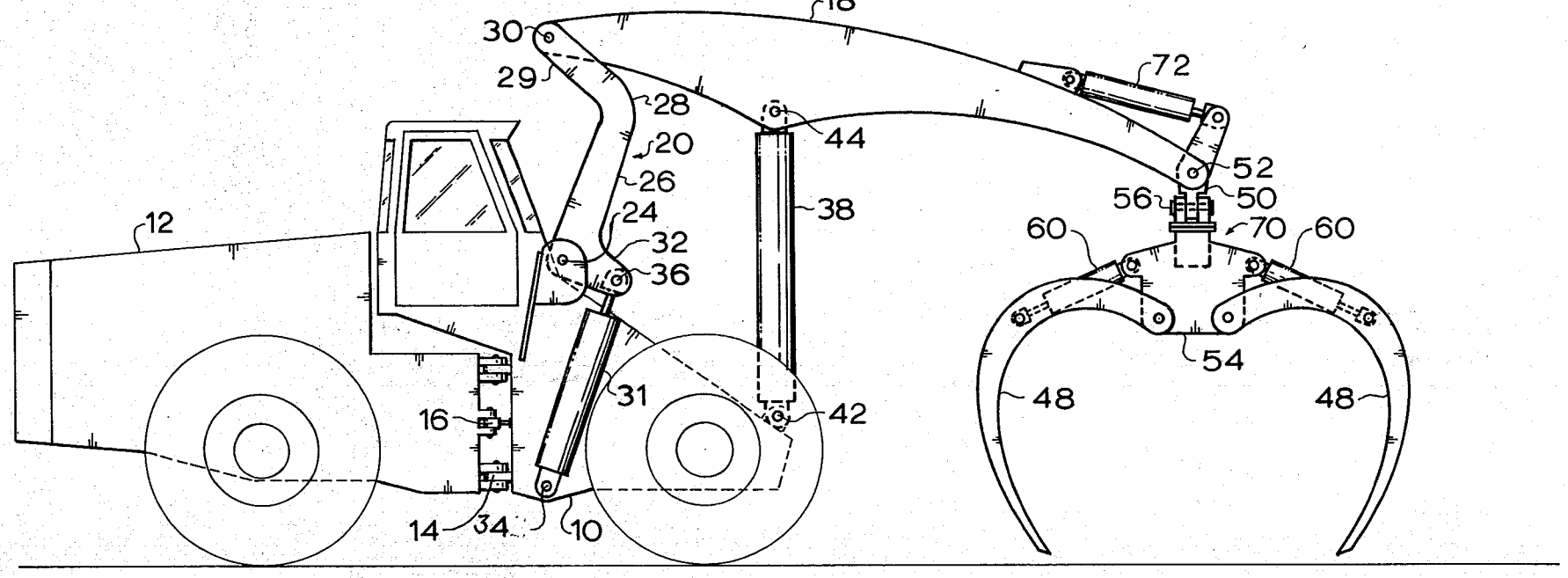
FIG. 2 shows a view similar to FIG. 1 with the boom extended and the cylinder retracted.

By contrasting the FIG. 1 and FIG. 2, it will be noted that the preferred arrangement of the inventive linkage including the selections and choices outlined above allows, (with links 20 fully retracted) the clam jaws to hang clear of the ground, (the solid line arrangement in FIG. 1) with the piston rod 40 almost retracted, and this is the lowest low gravity distribution. For fast highway travel, with rod 40 fully or almost fully retracted, the links 20 are retracted sufficiently to reduce sway, having regard for the type of load carried. The linkage, with piston rod 40 retracted, is designed to extend to a position (FIG. 2) where the clam jaws may reach below the level on which the articulated vehicle wheels are supported, either in the event of variation in terrain or a declivity in the loading area for another reason.

In FIG. 1 the deepest penetration with the specific linkage shown, is shown in chain dotted arrangement, with the jaws open and in ordinary dotting with the jaws closed. The deepest penetration has been achieved by extending the retracted linkage (solid line) with piston rod 40 almost but not fully retracted to the extended, dotted arrangement of the linkgage with piston rod 40 fully retracted.

As previously pointed out in the introduction, the operation of the linkage and boom to depress the clam jaws, with the piston rod 40, nearly or fully retracted, either toward or past the vehicle ground level provides greatly improved 'crowding qualities'. by 'crowding qualities' is meant the ease and sensitivity with which the clam jaws, under the control of the operator with the attached linkage arrangement, may penetrate and then, in closing, grasp the load.

To obtain convenience of arrangement for the stable, retracted position, the split boom members 18 allow location of these members on each side of the cab, while the elbow arrangement of the link 20 allows the boom-link connection 30 to be located rearwardly of the forward end of the cab but without interference therewith, and particularly without interference with the opening of side doors of the cab. This design allows the doors to be opened in the completely retracted position of the linkage as shown in FIG. 1. Since this is the closest approach of the linkage to the cab, the design allows the cab doors to be opened in any position of the linkage. This is a safety feature of some importance allowing escape for the operator in the event of hydraulic failure or other emergency.

Figures 3, 5:
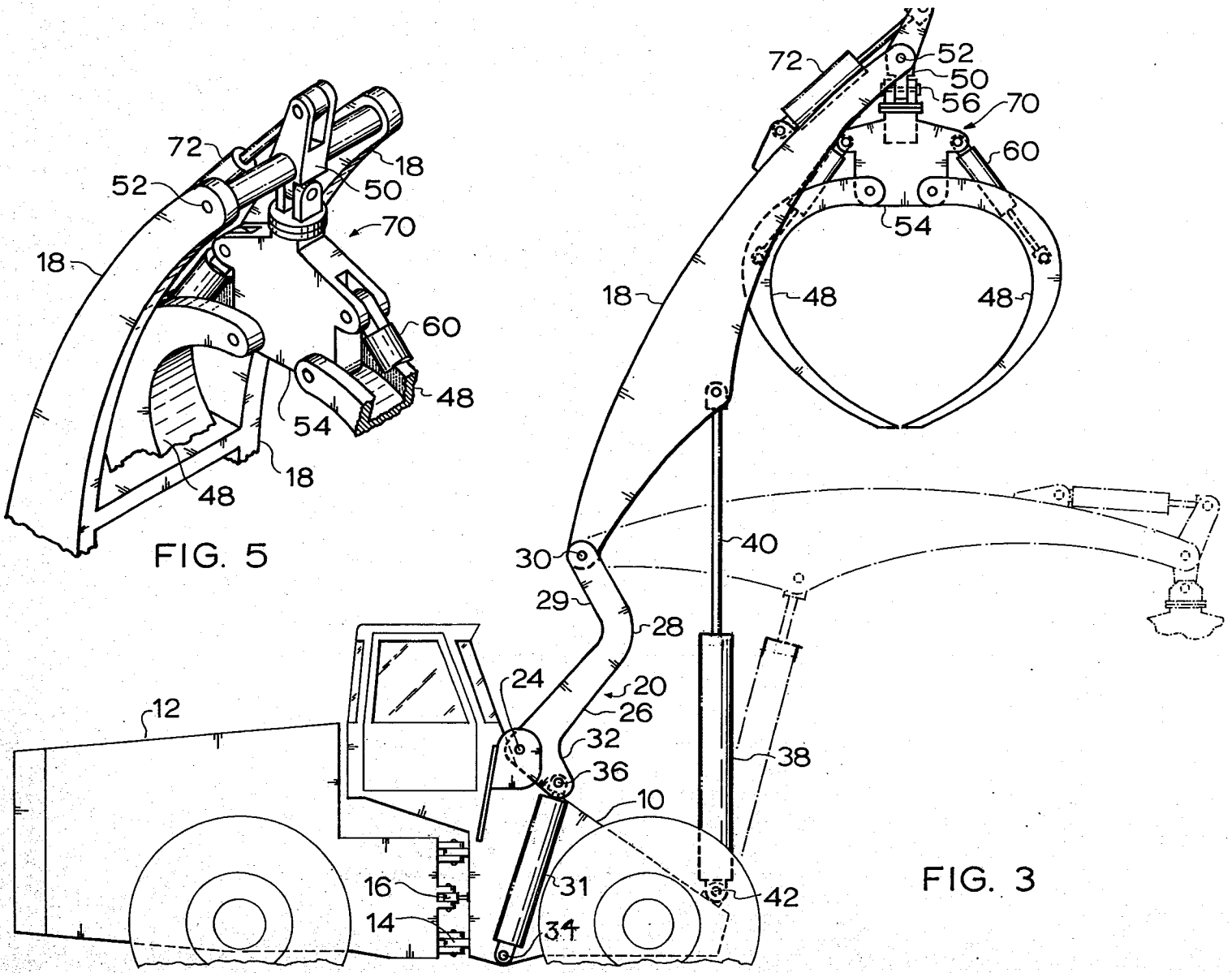
FIG. 3 shows a view similar to FIG. 1 with the cylinder in various stages of extension.
FIG. 5 shows a portion of the outer end of the boom.
Figure 4:
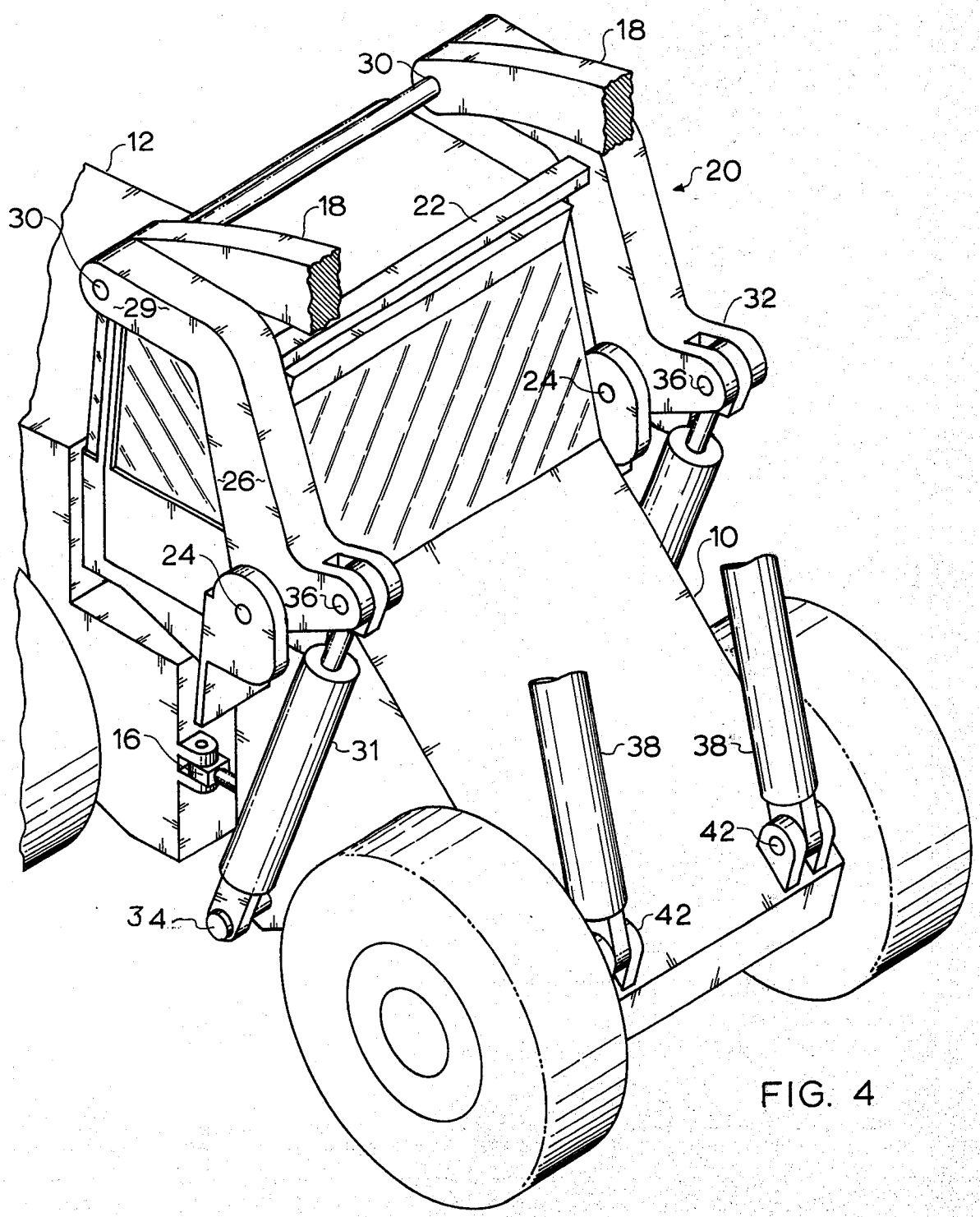
FIG. 4 shows a perspective view of a portion of the vehicle.

A further stability feature of the inventive linkage is demonstrated in FIG. 3 which shows the boom raised to its highest inclination by extending piston rod 40 until the jaws approach as closely as possible to the boom. This represents the most stable position in the sense of minimal cantilever effect of the boom and any load carried in the clam jaws; which load is, in the arrangement of FIG. 3 as close to the tipping line as possible. The tipping line is, in the vehicle shown, represented by the wheels of the forward articulated member. If the forward member of the articulated vehicle had more than a single pair of wheels, then the tipping line would of course be represented by the foremost set of wheels. Design features of the arrangement shown, tend to increase this stability. Thus the generally concave downward shape of the boom members 18 allows an increase in the inclination angle, since additional space is provided within the concavity for the nearer of the two jaws. Further additional stability is provided, when the axes of the jaws 48 are aligned with the boom, since the proximate one of the two jaws may be received for a short distance between the boom links 18 which are spaced to receive the jaws.

Although stable in the cantilever sense, the attitude of FIG. 3 is not the most stable for extended highway travel because of the high centre of gravity.

Stops for the movement of the link 20 forwardly and backwardly, are not shown since these may be provided internally of the piston cylinder 38. Exterior stops could be provided, if desired. The stops used, limit retractive movement of the linkage to that where the elbow shaped link is as close as desired to the cab; and limit extensive movement to that where the desired extension of the boom is obtained. In the preferred embodiment, the preferred maximum extended position is indicated in FIG. 3.

Similarly, although extermal stops may be provided to limit extension and retraction the linkage under the control of the piston rod 40 it is preferred to utilize internal stops in the piston cylinder 38.

In use, the extension and retraction of the boom is controlled by piston rod 40 operating to rotate link 20 and carrying with it the rotating piston cylinder 38 with rod 40 either moving simultaneously with link 20 or at constant extension. Thus the link 20, may when desired, be rotated independently of extension or retraction the piston rod 40. Coversely the linkage may be operated to raise and lower the boom through the operation of rod 40 in piston cylinder 38., independently or in conjunction with link 20.

Although the application is principally directed to vehicles where the operator is seated on the front articulated member, where the inventive linkage is mounted, in some vehicles designed to seat the operator on the rear articulated member, the operator's visibility may be sufficient to allow control of the linkage mounted on the front articulated member. With sufficient visibility the operator in the rear articulated member may control the linkage in accord with the invention, attached to the forward articulated member. This arrangement is not however felt to be as advantageous as the preferred arrangement where the operator as well as the linkage are on the preferred articulated member.

I claim:

1. An articulated vehicle comprising forward and rearward articulated wheel mounted members;

having a location on the forward articulated member for the operator to face in a forward direction thereon;

a boom mounted on said forward articulated member to extend forwardly therefrom;

the mounting for said boom comprising: a link structure pivotably connected adjacent its lower end to said forward articulated member about a first approximately horizontal axis;

and pivotably connected adjacent its upper end to said boom at a second axis substantially parallel to said first axis;

a controllably extensible hydraulic cylinder means pivotably connected adjacent one end to said forward articulated frame at a third axis, forwardly of said first axis and substantially parallel thereto;

said hydraulic cylinder means pivotably connected adjacent its other end to said boom at a fourth axis, forwardly of said second axis and parallel thereto;

said link being dimensioned and connected to pivot between a retracted position and an advanced position;

said boom moving with said link and hydraulic cylinder means when said link is moved between retracted and extended positions;

means for controlling and causing movement of said link, about said first pivot point, and with it said boom;

means for causing extension and retraction of said cylinder;

wherein said link, boom and hydraulic cylinder are so designed that with said hydraulic cylinder retracted and said link in the retracted position, said boom is approximately horizontal;

wherein said link and said boom are designed so that the outward end of the boom is lowered and raised respectively, when, with the hydraulic cylinder means retracted, the link is operated from the retracted position to the extended position, and from the extended position to the retracted position.

2. An articulated vehicle comprising forward and rearward articulated wheel mounted members;

a boom mounted on said forward articulated member to extend forwardly therefrom;

the mounting for said boom comprising: a link structure pivotably connected adjacent its lower end to said forward articulated member about a first approximately horizontal axis;

and pivotably connected adjacent its upper end to said boom at a second axis substantially parallel to said first axis;

a controllably extensible hydraulic cylinder means pivotably connected adjacent one end to said forward articulated frame at a third axis, forwardly of said axis and substantially parallel thereto;

said hydraulic cylinder means pivotably connected adjacent its other end to said boom at a fourth axis, forwardly of said second axis and parallel thereto;

said link being dimensioned and connected to pivot between a retracted position and an advanced position;

said boom moving with said link and hydraulic cylinder means when said link is moved between retracted and extended position;

means for controlling and causing movement of said link, about said first pivot, and with it said boom;

and means fo causing extension and retraction of said cylinder;

wherein said link, boom, and hydraulic cylinder are so designed that with said hydraulic cylinder retracted and said link in the retracted position, said boom is approximately horizontal;

wherein said link and said boom are designed so that the outward end of the boom is lowered and raised, respectively, when, with the hydraulic cylinder means retracted, the link is operated from the retracted position to the extended position, and from the extended position to the retracted position.

3. A device as claimed in claim 1 wherein the boom is curved to be generally concave downward between its link connection and its forward extremity; and wherein the boom is provided with clam arms suspended from its forward extremity and connected to depend downwardly therefrom.

4. A device as claimed in claim 3 wherein the boom is provided with clam arms, each mounted to swing open about a predetermined axis, said axes beng substantially parallel, said arms having a predetermined thickness in said axial direction, and wherein said boom is constructed with spaced parallel arms adjacent said forward extremity, such spacing being sufficient to receive such thickness between said boom arms.

5. A device as claimed in claim 1, wherein said link is provided to be elbow shaped and include a first extent arranged to extend upward from said first pivot point and a second extent, extending rearwardly to the second pivotal axis from the upper end of said first extent.

6. A device as claimed im claim 5 wherein said forward articulated member is provided with a cab to house the operator and said cab is provided with side doors and wherein said elbow is dimensioned to allow, in the retracted position of said boom and link, opening of said side doors.

* * * * *